US006342864B1

(12) United States Patent
Muramoto et al.

(10) Patent No.: US 6,342,864 B1
(45) Date of Patent: Jan. 29, 2002

(54) SLOT ARRAY ANTENNA WITH CAVITIES

(75) Inventors: Mitsuru Muramoto; Kanemi Sasaki, both of Tokyo; Kiyohiko Itoh, 1-10, 16-chome, Minami5joNishi, Chuo-ku, Sapporo-shi, Hokkaido; Manabu Yamamoto, Sapporo, all of (JP)

(73) Assignees: Kokusai Electric Co., Ltd.; Kiyohiko Itoh, both of Tokyo (JP)

( * ) Notice: Subject to any disclaimer, the term of this patent is extended or adjusted under 35 U.S.C. 154(b) by 0 days.

(21) Appl. No.: 09/618,997

(22) Filed: Jul. 18, 2000

(30) Foreign Application Priority Data

Jul. 19, 1999 (JP) ..... 11-204661
Jul. 17, 2000 (JP) ..... 2000-21636

(51) Int. Cl.[7] ..... H01Q 13/10
(52) U.S. Cl. ..... 343/770; 343/700 MS
(58) Field of Search ..... 343/767, 768, 343/769, 770, 778, 779, 700 MS; 333/202

(56) References Cited

U.S. PATENT DOCUMENTS 4,132,995 A * 1/1979 Monser ..... 343/767
4,733,245 A * 3/1988 Mussler ..... 343/769
5,821,836 A * 10/1998 Katehi et al. ..... 333/202
5,990,835 A * 11/1999 Kuntzsch et al. .... 343/700 MS
6,144,344 A * 11/2000 Kim et al. ..... 343/770

* cited by examiner

*Primary Examiner*—Don Wong
*Assistant Examiner*—Hoang Nguyen
(74) *Attorney, Agent, or Firm*—McGinn & Gibb, PLLC

(57) ABSTRACT

A slot array antenna with a cavity of a simple construction having a plurality of slots formed on a dielectric substrate and capable of providing good directional characteristics while minimizing inter-slots coupling. The slot array antenna (1) includes a power supply line in the form of a micro-strip line formed on one surface of the dielectric substrate, a slot antenna portion (10) with a plurality of slots (14*a*, 14*b*, 14*c*, 14*d*) formed on the other surface of the dielectric substrate in an array-like fashion so as to extend perpendicularly to the micro-strip line with the dielectric substrate interposed therebetween, and a reflector (40) with a cavity (42) having an opening disposed in opposition to a plane on which the plurality of slots (14*a*, 14*b*, 14*c*, 14*d* exist). In this case, if the cavity has a width narrow enough to cut off a frequency of radio waves to be used, the directionality of the slot array antenna 1 can be optimized.

19 Claims, 6 Drawing Sheets

FIG.2A
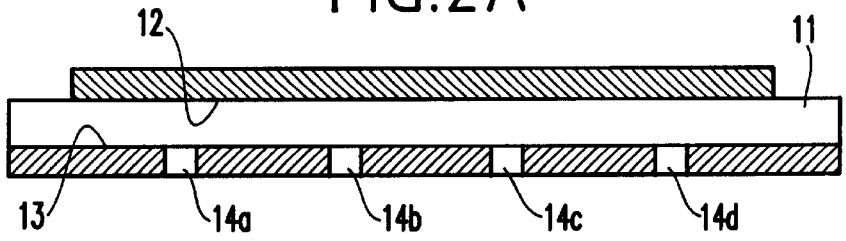
FIG.2B
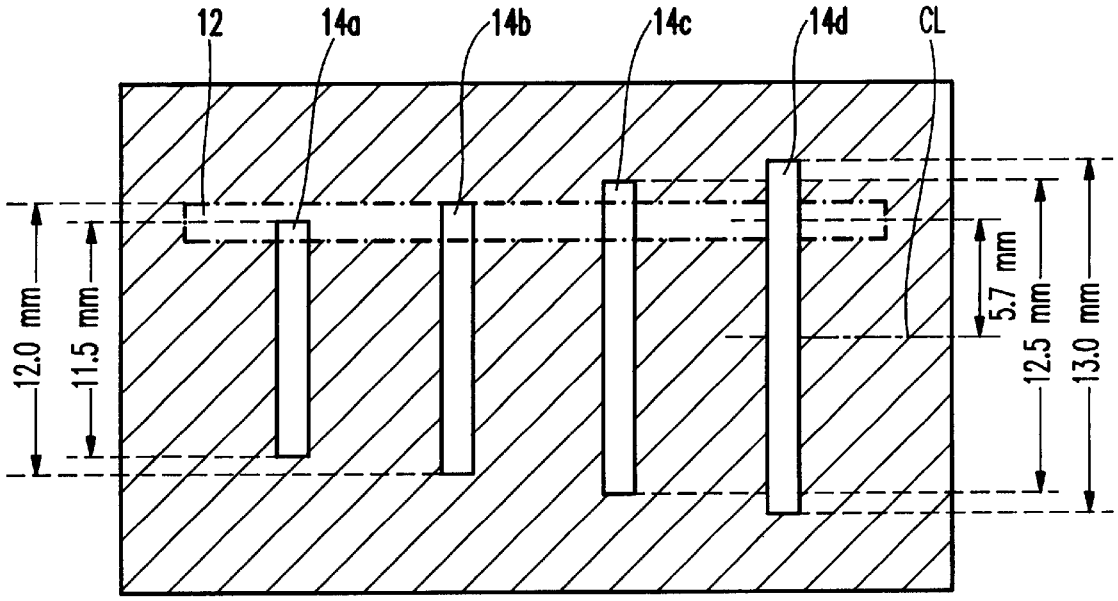
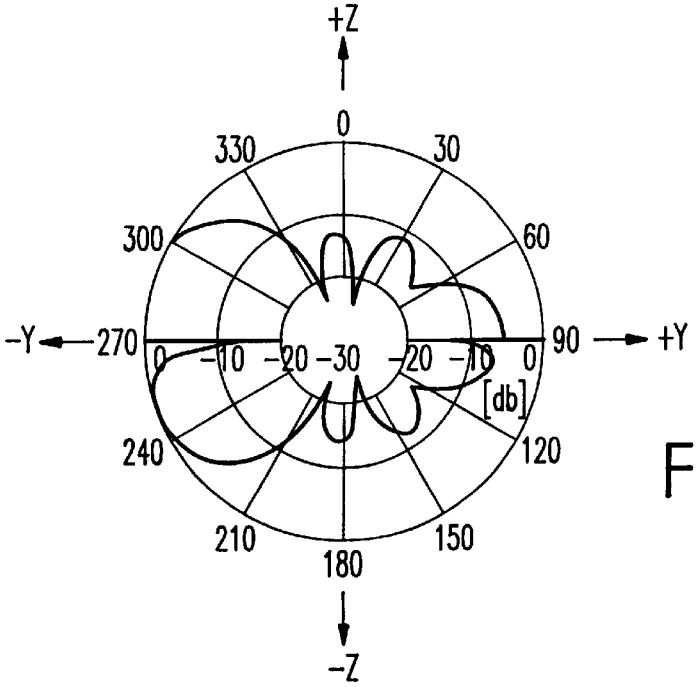
FIG.3

FIG.4
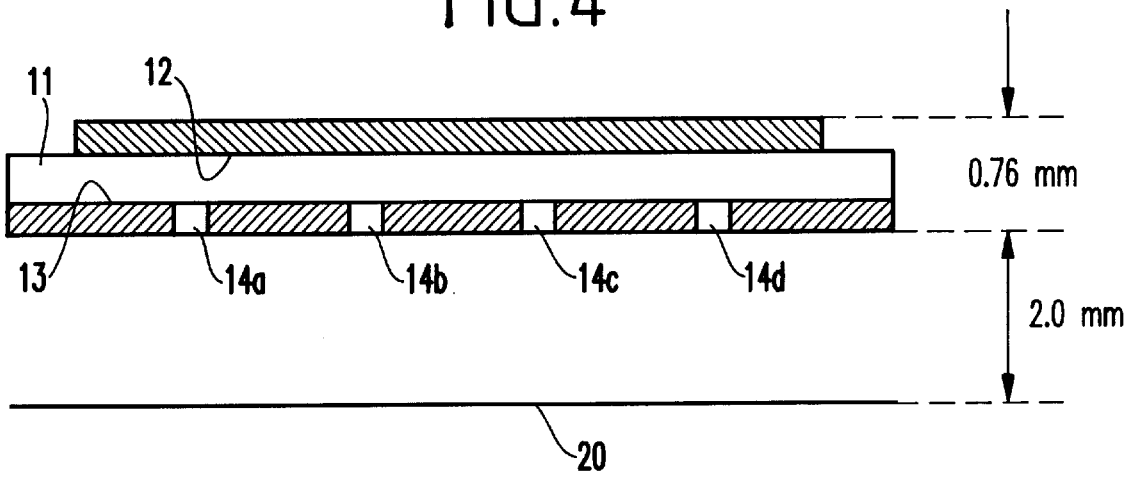
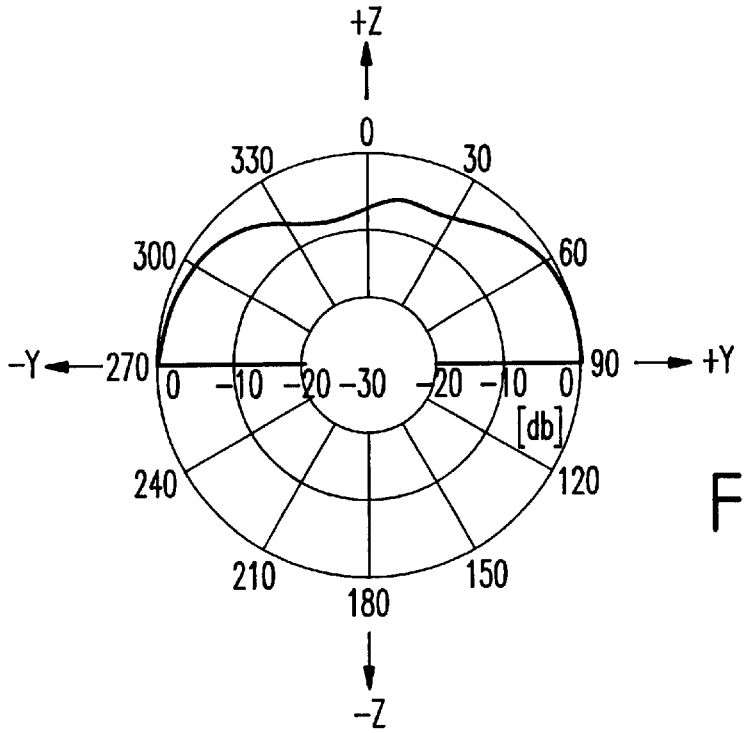
FIG.5

FIG.6
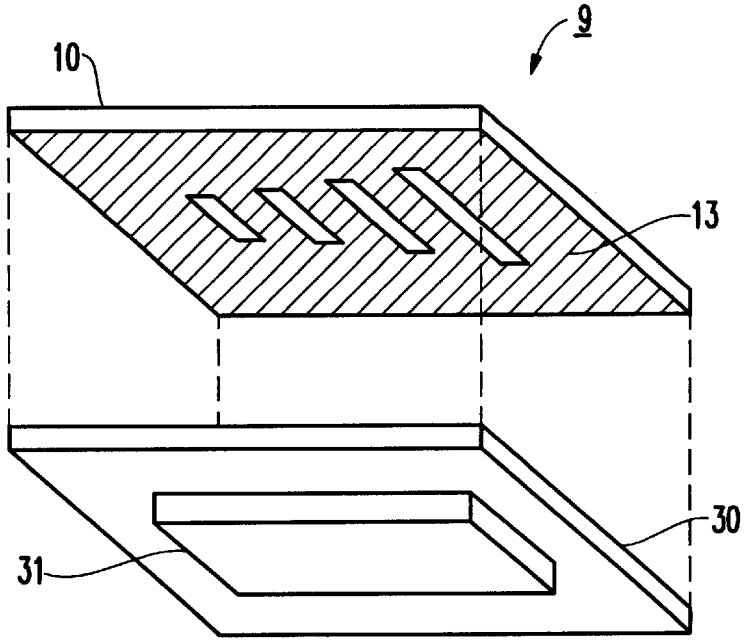
FIG.7A
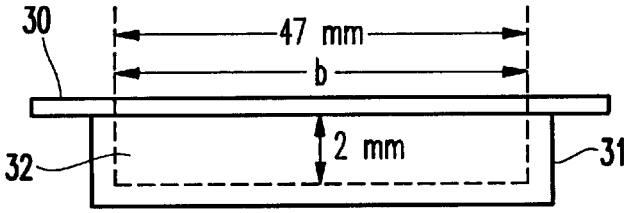
FIG.7B
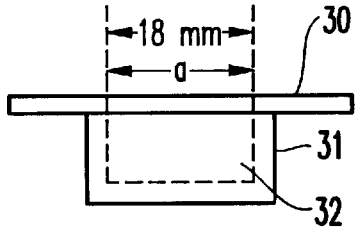
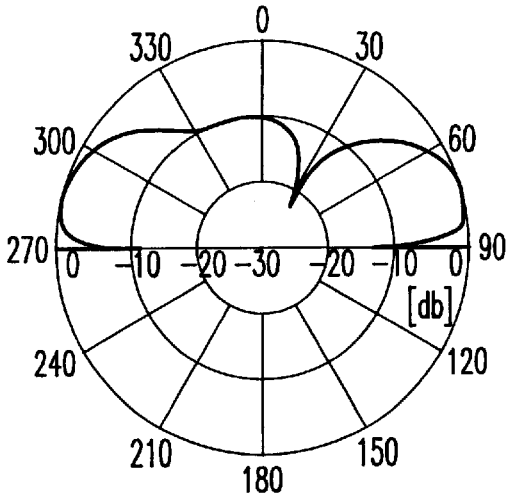
FIG.8

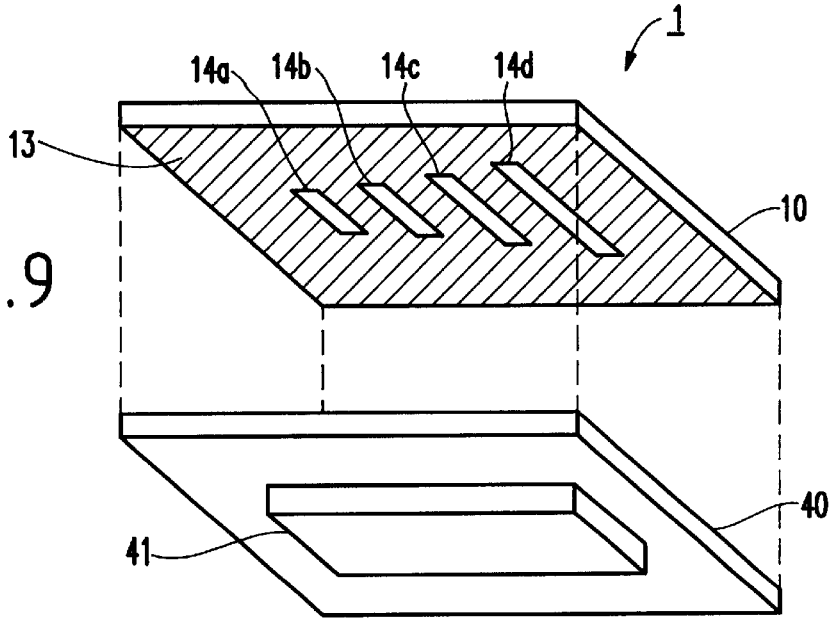
FIG.9
FIG.10A
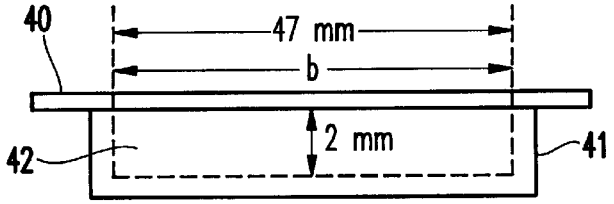
FIG.10B
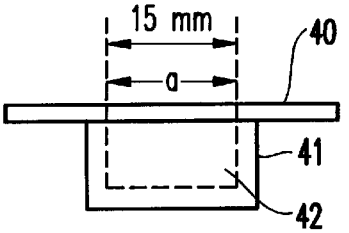
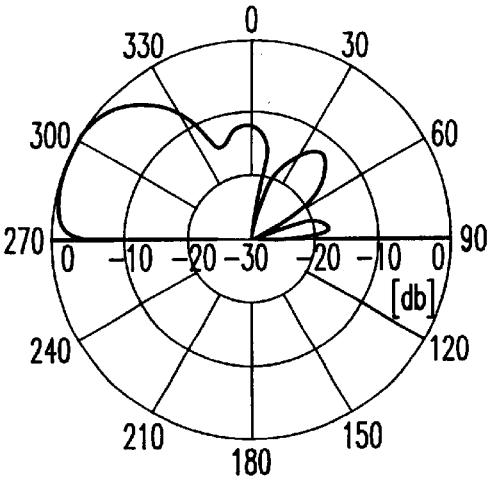
FIG.11

SLOT ARRAY ANTENNA WITH CAVITIES

BACKGROUND OF THE INVENTION

1. Field of the Invention

The present invention relates to a slot array antenna using a slot antenna portion which has a linear strip-shaped power supply line formed on one surface of a dielectric substrate and a plurality of slots formed in a conductive layer on the other surface of the dielectric substrate.

2. Description of the Related Art

In the past, such types of slot array antennae with directionality have widely been used for receiving radio waves coming from a desired direction, or for transmitting radio waves in a desired direction. Among these slot array antennae, a planar antenna constructed on a dielectric substrate is advantageous for reduction in size and weight thereof.

With such a slot array antenna having a plurality of slots formed on a dielectric substrate, there are the following two cases. That is, one case is that only a single element or slot is supplied with power, and the other case is that a plurality of elements or slots are supplied with power. In the former case, those elements other than the one supplied with power are made to function as reflectors or director. In contrast, in the latter case, a plurality of elements or slots are oscillated to provide a desired characteristic by adjusting the amplitude and phase given to each element in an appropriate manner. In this case, a micro-strip line is utilized as the power supply line for concurrently supplying power to the plurality of elements. In addition, there is another type of slot array antenna with slots directly formed in a power supply line in the form of wave guides without using a dielectric substrate.

With the conventional slot array antennae as referred to above, particularly in the case of using wave guides, it is difficult to machine and assembly them with high precision, and in the case of a slot array antenna having slots formed on a dielectric substrate, inter-slots coupling can not be neglected and hence it is also difficult to perform desired circuit designing while taking such inter-slots coupling into consideration.

SUMMARY OF THE INVENTION

The present invention is intended to obviate the above-mentioned problems encountered with the conventional slot array antennae, and has for its object to provide a novel and improved slot array antenna with a cavity which has slots formed on a dielectric substrate but is capable of providing good transmission directional characteristics while minimizing or disregarding inter-slots coupling.

Bearing the above object in mind, according to one aspect of the present invention, there is provided a slot array antenna with a cavity comprising: a slot antenna portion having a plurality of slots arranged in an arrayed fashion; and a reflector with a cavity having an opening disposed in opposition to a plane on which the plurality of slots exist.

Preferably, the cavity serves to cut off a frequency $\lambda$ of radio waves to be used. Specifically, assuming that the width and depth of the cavity are "a" and "b", respectively, for the frequency $\lambda$ to be used, then the relationship between the width "a" and the length "b" of the cavity is as follows:

$$a<b \text{ and } a<(\lambda/2)$$

Preferably, the slot antenna portion comprises: a dielectric substrate having a first surface and a second surface; a power supply line disposed on the first surface of the dielectric substrate; and a conductive layer disposed on the second surface of the dielectric substrate.

Preferably, the cavity has a width less than $\lambda/2$.

Preferably, the slot antenna portion comprises: a dielectric substrate having a first surface and a second surface; a power supply line disposed on the first surface of the substrate in close contact therewith so as to extend in a rectilinear strip-shaped fashion; and a conductive layer formed on the second surface of the dielectric substrate and having the plurality of slots formed therein in such a manner as to extend perpendicularly to the power supply line with the dielectric substrate interposed therebetween.

Preferably, the power supply line comprises a micro-strip line.

According to another aspect of the present invention, there is provided a slot array antenna system with cavities of a sector antenna type comprising: a plurality of sectors; and a plurality of slot array antennae each referred to above, the slot array antennae being disposed one for each of the plurality of sectors.

In a preferred embodiment of the invention, the slot array antenna with a cavity has a slot antenna portion 10 with a plurality of slots 14*a,* 14*b,* 14*c,* 14*d* arranged in an array, and a reflector 40 with a cavity 42 having an opening disposed in opposition to a plane on which the plurality of slots 14*a,* 14*b,* 14*c,* 14*d* exist.

With such an arrangement, the cavity of the reflector serves to diminish inter-slots coupling (i.e., coupling between the slots) to thereby adjust the directionality created by the slot antenna portion, so that a beam transmitted from or received by the slot antenna portion can be oriented in a desired direction, thus improving the directionality and the F/B ratio (i.e., front to back ratio) thereof. In this case, when the cavity functions to cut off the frequency of radio waves to be used, these characteristics can further be improved.

The above and other objects, features and advantages of the present invention will become apparent from the following detailed description of presently preferred embodiments of the invention taken in conjunction with the accompanying drawings.

BRIEF DESCRIPTION OF THE DRAWINGS

FIG. 1(*b*) is a perspective view showing a lower surface of the slot array antenna portion;

FIG. 2(*a*) is a cross sectional view of the slot array antenna portion of FIG. 1;

FIG. 2(*b*) is an arrangement view showing on an enlarged scale the relationship between slots in the slot array antenna portion and a micro-strip line of FIG. 1;

FIG. 3 is a view showing a directional characteristic of the slot array antenna portion of FIG. 1:

FIG. 4 is a view showing a flat reflector disposed in opposition to the slot array antenna portion of FIG. 1;

FIG. 5 is a view showing a transmission directional characteristic of the antenna of FIG. 4;

FIG. 6 is a view showing a slot array antenna with a cavity according to another embodiment of the present invention in which a reflector having a wide cavity is disposed in opposition to the slot array antenna portion of FIG. 1;

FIG. 7(*a*) is a front elevation of the reflector having a wide cavity of FIG. 6;

FIG. 7(*b*) is a side elevation of the reflector having a wide cavity of FIG. 6;

FIG. 8 is a view showing a transmission directional characteristic of the slot array antenna with a cavity of FIG. 6;

FIG. 9 is a view showing a slot array antenna with a cavity according to a further embodiment of the present invention in which a reflector with a narrow cavity is disposed in opposition to the slot array antenna portion of FIG. 1;

FIG. 10(*a*) is a front elevation of the reflector having a narrow cavity used with the slot array antenna with a cavity of FIG. 9;

FIG. 10(*b*) is a side elevation of the reflector having a narrow cavity of FIG. 9;

FIG. 11 is a view showing a transmission directional characteristic of the slot array antenna with a cavity of FIG. 9;

DESCRIPTION OF THE PREFERRED EMBODIMENTS

Now, preferred embodiments of the present invention will be described in detail, by way of example, while referring to the accompanying drawings.

Figure 1A:
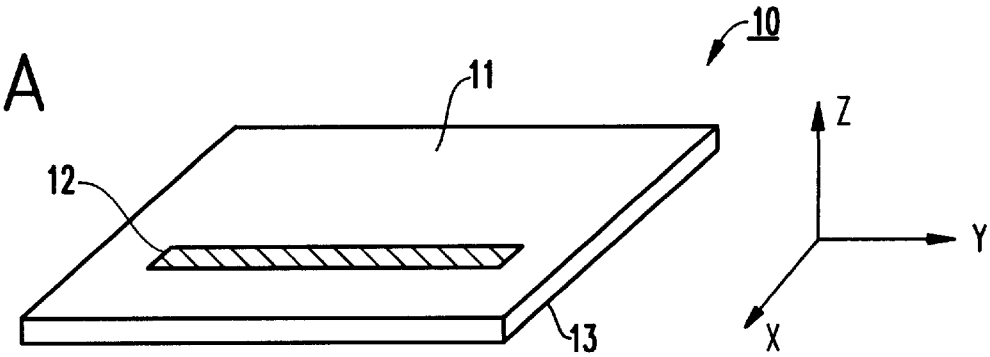
FIG. 1(*a*) is a perspective view showing an upper surface of a slot array antenna portion used in a slot array antenna with a cavity according to an embodiment of the present invention.
Figure 1B:
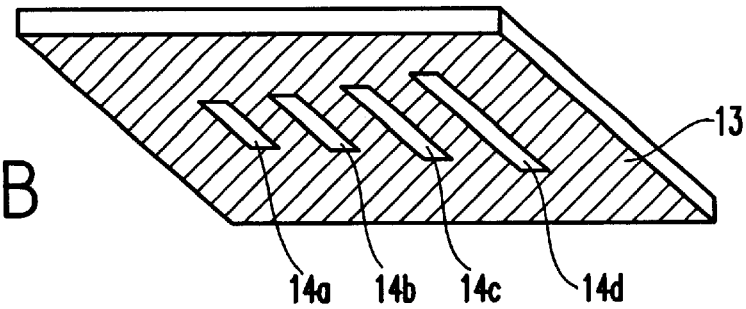

A slot antenna portion 10 of a slot array antenna shown in FIG. 1 includes a micro-strip line 12 disposed to rectilinearly extend over a dielectric substrate 11 for inputting and outputting a signal, a conductive layer 13 formed on a lower surface of the dielectric substrate 11 and serving as ground, and a plurality of slots 14*a,* 14*b,* 14*c,* 14*d* formed in the conductive layer 13 so as to extend in a direction perpendicular to the direction in which the micro-strip line 12 extends. In this embodiment, the plurality of slots 14*a,* 14*b,* 14*d,* 14*d* are disposed such that their centers are on a central line CL, as shown in FIG. 2(*b*). For example, the lengths of the respective slots 14*a,* 14*b,* 14*d,* 14*d* are set to be 11.5 mm, 12.0 mm, 12.5 mm, and 13 mm, respectively. In this embodiment, the number of the slots in an array is four with the above-mentioned dimensions, but it is of course without saying that the slots in an array may not be four but any other number and the dimensions of the respective slots may also be set otherwise, while attaining the effect of improving the transmission directional characteristics of the antenna, which is provided by the addition of a cavity.

The slot antenna portion 10, as constructed in the above manner, presents a calculated transmission directional characteristic as illustrated in FIG. 3. In this case, calculations are effected on the assumption that the conductive layer 13 extends infinitely since it is sufficiently wide. Also, discontinuation of indication in directions of 0 (+Z), 180 (−Z), 90 (+Y), 270 (−Y) degrees is due to the fact that the conductive layer 13 is made as ground and hence regarded as an infinite earth plate. In this connection, it is to be noted that in order to make valid the +Z directional component alone of the transmission directional characteristic shown in FIG. 3, a reflector 20 is disposed in opposition to the slots 14*a,* 14*b,* 14*c,* 14*d,* as generally depicted in FIG. 4. The slot antenna portion 10 comprising the respective members 11, 12, 13 is 0.76 mm thick and the reflector 20 is positioned at a location 2.0 mm away from the conductive layer 13. In this case, assuming that the conductive layer 13 and the reflector 20 extend infinitely, the transmission directional characteristic is calculated as shown in FIG. 5. The reflector 20 can be formed of metal such as aluminum, brass, copper, iron, etc.

As will be clear from FIG. 5, the level in the +Y direction becomes greater than the level in the −Y direction, and hence so-called F/B ratio (front to back ratio) is extremely deteriorated. Thus, FIG. 6 shows a structure to improve this. In this case, those portions of the reflector 20 which confront with the slots 14*a,* 14*b,* 14*c,* 14*d* are drawn downwardly in a rectangular shape to form a drawn portion 31, thereby providing a reflector 30 with a cavity. The interior of the reflector 30 serves as a cavity 32 of FIG. 7, which has a length of 47 mm in the Y direction, a width of 18 mm in the X direction, and a depth of 2 mm. In this case, the transmission directional characteristic of the slot array antenna 9 shown in FIG. 6 is improved in the sharpness of a beam transmitted therefrom, but no substantial improvement can be seen with respect to the F/B ratio thereof. Here, it is understood that this is caused by the following reason. That is, assuming the wavelength of a signal used is $\lambda$, the width of the cavity is greater than $\lambda/2$ and hence the cavity does not serve to cut off the frequency of radio waves to be used. Here, note that in this embodiment, $\lambda$ is 30.8 mm (9.75 GHz).

Figure 13:
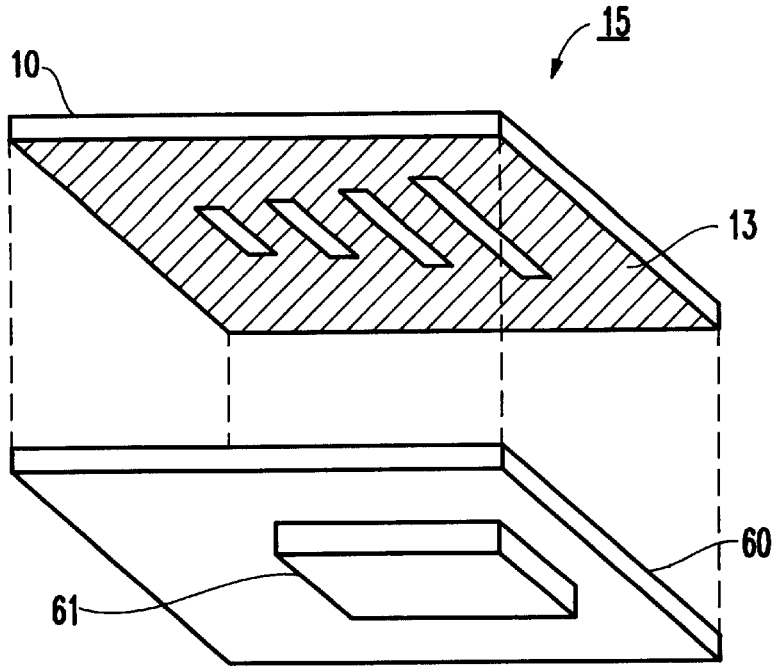
FIG. 13 is a view showing a slot array antenna with a cavity according to a still further embodiment of the present invention in which a reflector having a cavity of a short length is disposed in opposition to the slot array antenna portion of FIG. 1.

To improve this, a slot array antenna 1 with a cavity according to another embodiment of the present invention is illustrated in FIG. 9. In this slot array antenna 1, a reflector 40 having a cavity is employed in place of the reflector 30 having a cavity of FIG. 6, and has a drawn portion 41 which is provided with a cavity 42 having a length of 47 mm and a width of 15 mm. The distance between the substrate and the cavity 32 is set to be 2 mm. Thus, the slot array antenna 1 is of the same construction as that of the slot array antenna 9 excepting that the width of the cavity 42 is 15 mm instead of 18 mm. Since this slot array antenna 1 with a cavity is constructed such that the width of the cavity 42 is 15 mm and less than $\lambda/2$, there takes place no wave-guiding mode, thereby making it possible to extremely diminish the mutual coupling between the slots within the cavity 42. Moreover, there has been found substantially no deterioration in the transmission directional characteristic due to the addition of the cavity 42. That is, it is utilized that the cavity 42 employed here cuts off the related frequency, so there is no transmission of radio waves of the frequency therethrough. Such utilization of the cavity is completely different from the use of a wave guide which is employed for the purpose of transmitting radio waves. The transmission directional characteristic of the slot array antenna 1 with a cavity is depicted in FIG. 11. As will be clear from FIG. 11, the beam transmitted from the slot array antenna 1 can be limited or focused in a single direction, and the F/B ratio is improved to a substantial extent. In this regard, note that all the slots may not be disposed within the cavity 40, but instead only a part of the slots may be covered by the cavity, as shown in FIG. 13.

Figure 12:
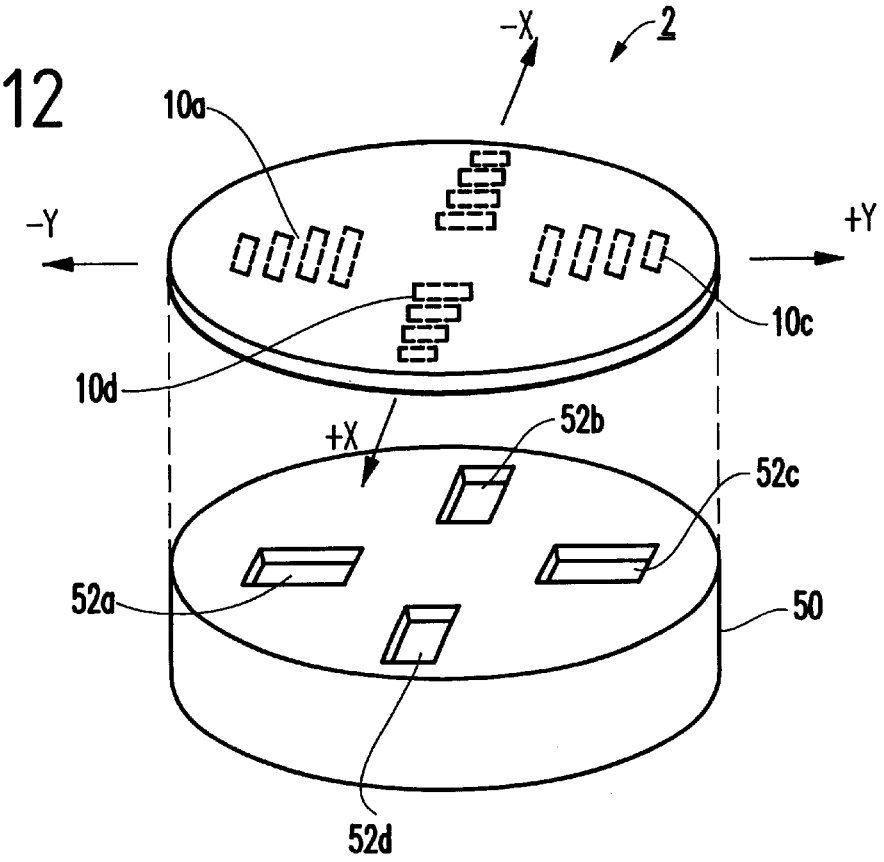
FIG. 12 is a view showing a slot array antenna system of a sector antenna type with cavities according to a yet further embodiment of the present invention.

As described above, the slot array antenna portion 10 used for the slot array antenna 1 with a cavity according to the present invention is a directional antenna formed on a dielectric substrate, and hence the slot array antenna 1 can be divided into a plurality of sectors by arranging a plurality of slot array antenna portions on the single dielectric substrate. FIG. 12 illustrates a slot array antenna system 2 with cavities comprising four slot array antennae having four slot array antenna portions 10*a,* 10*b,* 10*c,* 10*d* which are disposed on a dielectric substrate to form four sectors, though the number of slot array antenna portions is not limited to four. In the case of the slot array antenna system 2 with cavities of FIG. 12, a plurality of cavities 52*a*, 52*b*, 52*c*, 52*d* are formed through a conductive plate 50 of a sufficient thickness at locations confronting with the slot array antenna portions 10*a*, 10*b*, 10*c*, 10*d*, respectively.

The relationships between the slot array antenna portions 10*a*, 10*b*, 10*c*, 10*b* and the cavities 52*a*, 52*b*, 52*c*, 52*d* of FIG. 12 are the same as those shown in FIGS. 9 and 10, and are set to have the same characteristic as that shown in FIG. 11. In addition, although in FIG. 12, the cavities 52*a*, 52*b*, 52*c*, 52*d* are shown as an integral unit, they can be formed separately from each other as the case may be. The above-mentioned slot array antenna portions 10*a*, 10*b*, 10*c*, 10*d* can be formed with ease, for example, by removing the corresponding portions of the conductive layer 13 formed on the lower surface of the dielectric substrate 11 (see FIG. 2(*a*)) by means of etching. Also, the micro-strip lines 12 can be formed easily, for example, by leaving the corresponding portions of the conductive layer 13 on the upper surface of the dielectric substrate 11 (see FIG. 2(*a*)) and removing the other unnecessary portions thereof through etching. In particular, the slot array antennae 1, 2 with cavities as shown in FIGS. 9 through 12 can provide an antenna having a sharp beam and good characteristics such as the F/B ratio at low costs with respect to a high speed wireless transmission system using high frequency millimeter waves and the like.

As described in detail in the foregoing, a slot array antenna with a cavity according to the present invention includes a slot array antenna portion provided with a plurality of slots arranged in an arrayed fashion, and a reflector with a cavity having its opening disposed in opposition to a planar surface on which the plurality of slots exist. With this arrangement, it is possible to realize characteristics of reduced inter-slots coupling and having a sharp beam at low costs. In this case, provided that the cavity serves to cut off radio waves of the frequencies used, the characteristics can further be improved such as by an improvement in the F/B ratio.

Moreover, the slot array antenna portion has a power supply line disposed in close contact with and extending over one surface of the dielectric substrate in a rectilinear strip-shaped fashion, and a plurality of slots formed in a parallel relation with respect to each other on a conductive layer on the other surface of the dielectric substrate and disposed perpendicular to the power supply line with the dielectric substrate interposed therebetween. With this arrangement, it is possible to fabricate the slot array antenna portion without difficulty by performing an etching treatment on the conductive layers formed on the opposite surfaces of the dielectric substrate.

Further, by disposing the slot array antenna in each of a plurality of sectors of a dielectric substrate, it is possible to provide a small-sized and high-performance slot array antenna system of the sector antenna type with cavities.

While the invention has been described in terms of several preferred embodiments, those skilled in the art will recognize that the invention can be practiced with modification within the spirit and scope of the appended claims.

What is claimed is:

1. A slot array antenna with a cavity comprising:

a slot antenna portion having a plurality of slots arranged in an arrayed fashion; and a reflector with a cavity having an opening disposed in opposition to a plane on which said plurality of slots exist, wherein said cavity serves to cut off a frequency $\lambda$ of radio waves to be used, and wherein said cavity has a width less than $\lambda/2$.

2. A slot array antenna system with cavities of a sector antenna type comprising:

a plurality of sectors; and a plurality of slot array antennas as claimed in claim 1, said slot array antennas being disposed one for each of said plurality of sectors.

3. The slot array antenna with a cavity according to claim 1, wherein said slot antenna portion comprises:

a dielectric substrate having a first surface and a second surface;

a power supply line disposed on the first surface of said dielectric substrate; and a conductive layer disposed on the second surface of said dielectric substrate.

4. The slot array antenna with a cavity according to claim 3, wherein said power supply line comprises a micro-strip line.

5. A slot array antenna system with cavities of a sector antenna type comprising:

a plurality of sectors; and a plurality of slot array antennas as claimed in claim 4, said slot array antennas being disposed one for each of said plurality of sectors.

6. A slot array antenna system with cavities of a sector antenna type comprising:

a plurality of sectors; and a plurality of slot array antennas as claimed in claim 3, said slot array antennas being disposed one for each of said plurality of sectors.

7. The slot array antenna with a cavity according to claim 1, wherein said slot antenna portion comprises:

a dielectric substrate having a first surface and a second surface;

a power supply line disposed on the first surface of said substrate in close contact therewith so as to extend in a rectilinear strip-shaped fashion; and a conductive layer formed on the second surface of said dielectric substrate and having said plurality of slots formed therein in such a manner as to extend perpendicularly to said power supply line with said dielectric substrate interposed therebetween.

8. The slot array antenna with a cavity according to claim 7, wherein said power supply line comprises a micro-strip line.

9. A slot array antenna system with cavities of a sector antenna type comprising:

a plurality of sectors; and a plurality of slot array antennas as claimed in claim 8, said slot array antennas being disposed one for each of said plurality of sectors.

10. A slot array antenna system with cavities of a sector antenna type comprising:

a plurality of sectors; and a plurality of slot array antennas as claimed in claim 7, said slot array antennas being disposed one for each of said plurality of sectors.

11. The slot array antenna with a cavity according to claim 1, wherein only a portion of said plurality of slots are disposed in opposition to said cavity.

12. The slot array antenna with a cavity according to claim 1, wherein a length of each slot of said plurality of slots is incrementally increased or decreased in comparison to a length of a previous or subsequent slot.

13. The slot array antenna with a cavity according to claim 12, wherein said length of each of said plurality of slots increase or decrease in 0.5 mm increments.

14. The slot array antenna with a cavity according to claim 1, wherein each of said plurality of slots are arranged in order from shortest to longest on a substrate.

15. The slot array antenna with a cavity according to claim 1, wherein each of said plurality of slots are arranged such that their centers are on a central line.

16. The slot array antenna according to claim 1, wherein said cavity comprises sidewalls perpendicular to a plane of said reflector and said plane on which said plurality of slots exist.

17. The slot array antenna with a cavity according to claim 1, wherein said plurality of slots comprises four slots.

18. A slot array antenna system with cavities of a sector antenna type comprising:

a plurality of sectors; and a plurality of slot array antennae as claimed in claim 1, said slot array antennae being disposed one for each of said plurality of sectors.

19. The slot array antenna with a cavity according to claim 18, wherein said plurality of sectors are on a single dielectric substrate.

* * * * *

UNITED STATES PATENT AND TRADEMARK OFFICE

CERTIFICATE OF CORRECTION

PATENT NO. : 6,342,864 B1
DATED : January 29, 2002
INVENTOR(S) : Muramoto et al.

It is certified that error appears in the above-identified patent and that said Letters Patent is hereby corrected as shown below:

Title page,
Item [73], please change the [73] Assignees to:
-- Kokusai Electric Co., Ltd., of Tokyo (JP); Kiyohiko Itoh, of Sapporo (JP) --.

Item [30], please change Foreign Application Priority Data to:
-- July 19, 1999 (JP)…….. 11-204661
July 17, 2000 (JP)…….. 2000-216136 --.

Signed and Sealed this

Tenth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,342,864 B1
DATED : January 29, 2002
INVENTOR(S) : Muramoto et al.

It is certified that error appears in the above-identified patent and that said Letters Patent is hereby corrected as shown below:

Title page,
Item [73], change Assignees to: -- Hitachi Kokusai Electric Inc., of Tokyo (JP); Kiyohiko Itoh, of Sapporo (JP) --.

Signed and Sealed this

Twenty-sixth Day of November, 2002

*Attest:*

*Attesting Officer*

JAMES E. ROGAN
*Director of the United States Patent and Trademark Office*